United States Patent [19]

DiGiovanni

[11] Patent Number: 4,503,737

[45] Date of Patent: Mar. 12, 1985

[54] THREADED FASTENER REMOVING TOOL

[76] Inventor: Donald DiGiovanni, 2769 Ware Rd., Rockford, Ill. 61111

[21] Appl. No.: 634,661

[22] Filed: Jul. 26, 1984

Related U.S. Application Data

[63] Continuation of Ser. No. 483,542, Apr. 11, 1983, abandoned.

[51] Int. Cl.[3] ..... B25B 15/00

[52] U.S. Cl. ..... 81/436; 81/441

[58] Field of Search ..... 81/436, 441

[56] References Cited

U.S. PATENT DOCUMENTS

| | | | |
|---|---|---|---|
| 52,631 | 2/1866 | Weaver | 81/436 |
| 1,604,032 | 10/1926 | Ferrell | 81/441 |
| 2,193,477 | 3/1940 | De Vellier | 81/436 |
| 4,269,246 | 5/1981 | Larson et al. | 81/460 |

FOREIGN PATENT DOCUMENTS

| | | | |
|---|---|---|---|
| 113786 | 2/1926 | Switzerland | 81/436 |
| 662318 | 12/1951 | United Kingdom | 81/436 |

*Primary Examiner*—Frederick R. Schmidt
*Assistant Examiner*—J. T. Zatarga
*Attorney, Agent, or Firm*—Marshall, O'Toole, Gerstein, Murray & Bicknell

[57] ABSTRACT

A tool for engaging a damaged or mutilated hexagonal socket in a threaded fastener, or the like, so that sufficient torque may be applied to the fastener to effect unthreading and removal thereof from a part with which the fastener is engaged. One end portion of the tool is tapered and hexagonal in cross section, thereby providing three pairs of opposite sides. Each side is tapered inwardly by a predetermined angle which permits the sides of the end portion to wedge against respective walls of the socket when forcefully driven therein. The opposite ones of each pair of sides of the end portion are spaced by a gauge width which, together with the taper of the sides, coact to prevent the end portion of the tool from bottoming in the socket when the tool is fully engaged in the socket.

4 Claims, 6 Drawing Figures

THREADED FASTENER REMOVING TOOL

This application is a continuation of application Ser. No. 483,542, filed Apr. 11, 1983 now abandoned.

BACKGROUND OF THE INVENTION (1) Field of the Invention

This invention relates to a tool for removing a threaded fastener having a damaged or multilated wrench receiving recess therein, and more particularly relates to a tool for removing cap screws, set screws, and other threaded devices having a damaged or mutilated, hexagonally-shaped, torque receiving recess therein.

(2) Description of the Prior Art

Various devices have been heretofore developed for effecting removal of threaded fasteners from a part or member with which the fastener was engaged, either because a conventional tool could not apply sufficient torque to the fastener to effect removal thereof or because the head of the fastener was damaged to the extent that a conventional tool could not properly engage the fastener. Examples of some tools which have been developed for effecting the removal of screws having damaged heads are disclosed in the Hilsinger U.S. Pat. No. 2,750,821 and Cummaro U.S. Pat. No. 2,815,054 patents. These devices were, however, complex in construction and difficult to use.

Devices have also been developed for removing broken or damaged studs. Examples of such devices are disclosed in the Murphree U.S. Pat. No. 1,547,944 and Ferrell U.S. Pat. No. 1,604,032 patents. However, the latter two devices required drilling of a hole in the damaged stud before the removing tool could be engaged therewith to effect unthreading of the stud.

The problem of removing cap screws having hexagonal sockets in the head thereof has been particularly difficult whenever the socket in the head became damaged or mutilated to the extent that an appropriately sized Allen wrench, or other torque applying tool, could not properly engage and transmit torque to the screw. A screw extracting tool ostensibly capable of removing cap screws having hexagonally-shaped recesses in the heads thereof is disclosed in the Joyce U.S. Pat. No. 2,923,335. However, due to the high amount of torque required to effect disengagement of cap screws or set screws which have been overtightened, rusted, or otherwise abnormally engaged with an associated part, the extracting tool disclosed in the Joyce U.S. Pat. No. 2,923,335, could not be relied upon to apply the degree of torque necessary to effect removal of the screw.

SUMMARY OF THE INVENTION

Briefly described, in its broadest aspects, the present invention contemplates a tool for engaging a damaged or mutilated recess in a threaded fastener so that sufficient torque may be applied thereto to effect removal of the fastener. In its more specific aspects, the present invention contemplates a tool which may be driven into a damaged or multilated hexagonal socket in a cap screw, set screw, or other externally or internally threaded device, so that sufficient torque may be applied to the fastener, or other device, through the tool, to unthread the same from a part or member with which the fastener is threadedly engaged.

The tool of the present invention, to be hereinafter described in detail, generally comprises an elongated tool body, having a tapered end portion that is adapted to be forcefully driven into a damaged or mutilated hexagonal recess or socket in the head of a fastener so that torque can be applied to the fastener to effect removal thereof. At least the end portion of the tool is hexagonal in cross section so that the end portion has three pairs of opposite sides, each side being tapered inwardly by an angle of between about 2 to 4 degrees with respect to the axis of the body. In addition, the opposite sides of each pair are spaced by a gauge width such that the sides will wedge against the walls of the recess in the fastener and before the end portion bottoms in the recess. The angle of taper of the sides of the end portion, and the gauge widths between each pair, is such as to limit the penetration of the tapered end portion to between about 15 to 30 percent of the total depth of the recess when the end portion is fully wedged in the recess.

Accordingly, it is a general object of the present invention to provide a novel and improved tool that may be forcefully driven into a damaged or mutilated recess in a threaded fastener so that sufficient torque may thereafter be applied to the fastener through the tool to effect unthreading of the fastener.

A specific object is to provide a novel threaded fastener removing tool of the foregoing character, which is specifically adapted to engage and apply torque to a damaged or mutilated hexagonal socket in a cap screw, set screw, or the like, to effect unthreading thereof from an associated part.

Another object is to provide a novel and improved tool of the foregoing character, which is simple in construction, reliable in operation, and economical to manufacture and maintain.

These and other objects and advantages of the invention will become apparent from the following detailed description and accompanying sheet of drawings, in which:

DESCRIPTION OF THE PREFERRED EMBODIMENT

Figure 1:
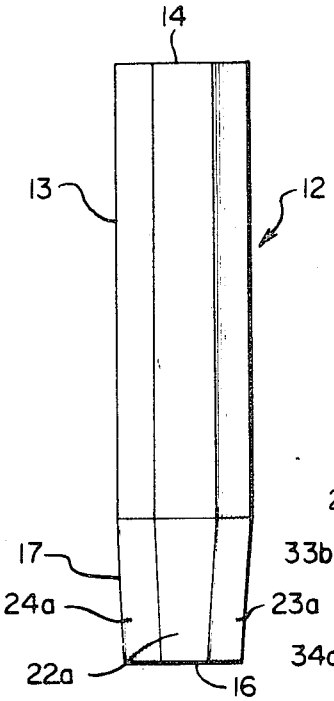
FIG. 1 is an elevational view of a tool for removing threaded fasteners having a mutilated or otherwise damaged hexagonally-shaped recess or socket therein which prevents removal of the fastener by a conventional wrench.
Figure 2:
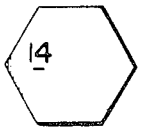
FIGS. 2 and 3 are top and bottom plan views, respectively, of the tool illustrated in FIG. 1.
Figure 3:
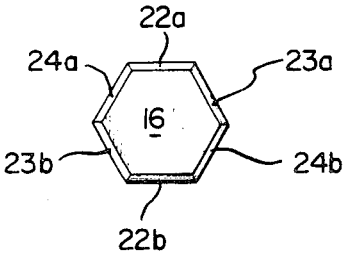

In FIGS. 1, 2, and 3, a threaded fastener removing tool, embodying the features of the present invention, is illustrated and indicated generally at 12. The tool 12, in the present instance, comprises an elongated tool body 13, which is preferably hexagonally-shaped in cross section, and having an upper or impact receiving end 14 and a lower end 16. The tool body 13 is preferably hexagonal in cross section, and the lower end 16 is smaller than the upper end 14.

According to the present invention, a portion 17 of the tool body 13, adjacent to the lower end 16, is tapered. Consequently, the tapered, lower end portion 17, which is also hexagonal in cross section, provides three pairs of oppositely arranged sides, respectively indicated at 22*a*,22*b*, 23*a*,23*b*, and 24*a*,24*b*. The tool body 13 may be of cold drawn 41L42 annealed hexagon stock. However, the portion 17 is flame hardened to a hardness of 55 to 58 on the Rockwell "c" scale.

Figure 5:
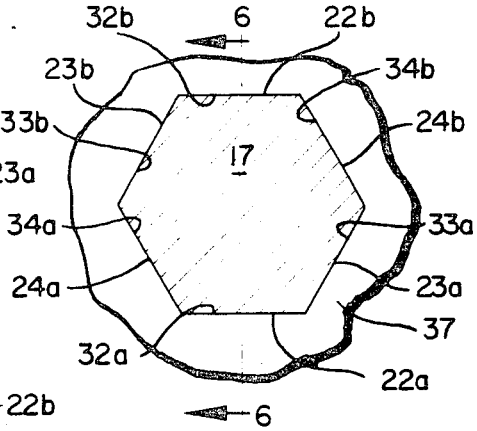
FIG. 5 is a horizontal sectional view taken along the line 5—5 of FIG. 4.
Figure 4:
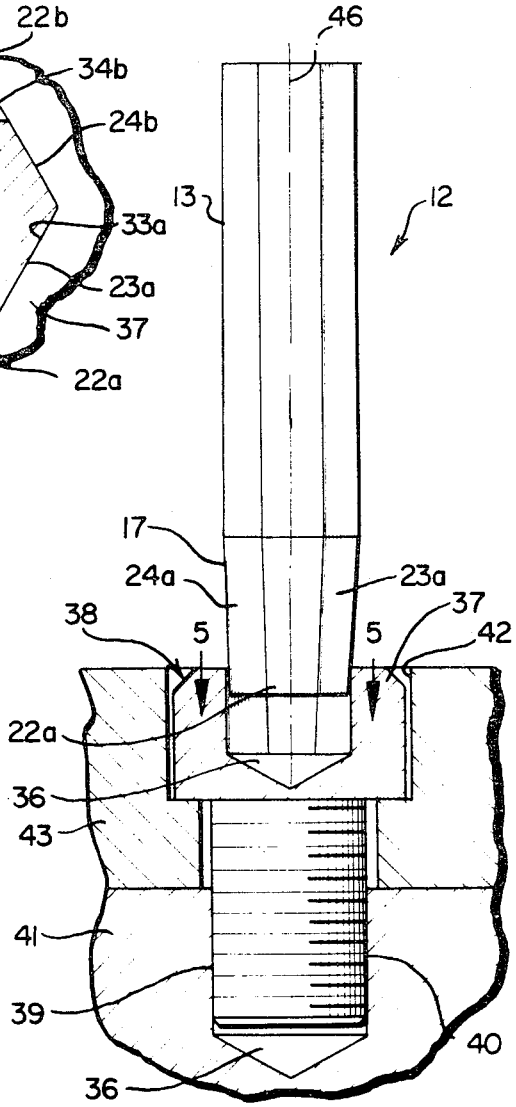
FIG. 4 is a vertical sectional view, with some parts in elevation, showing the approximate position of the tool illustrated in FIG. 1 when operatively engaged in the hexagonal socket of a cap screw.

Referring now to FIGS. 4 and 5 in conjunction with FIGS. 1, 2, and 3, the tool 12 is shown as it would appear when the lower or tapered end portion 17 is operatively engaged with the walls, respectively indicated at 32*a*,32*b*, 33*a*,33*b*, and 34*a*,34*b*, of a hexagonally-shaped recess or socket 36 in the head, indicated at 37, of a cap screw 38. The cap screw 38 includes an externally threaded shank 39 which, in the present instance, is shown engaged with the internal threads, indicated at 40, in a member or part 41. The head 37 of the cap screw 38 is shown seated in a recess 42 in a plate-like part 43, for example, which is held to the part 41 by the head 37 of the cap screw 38.

Figure 6:
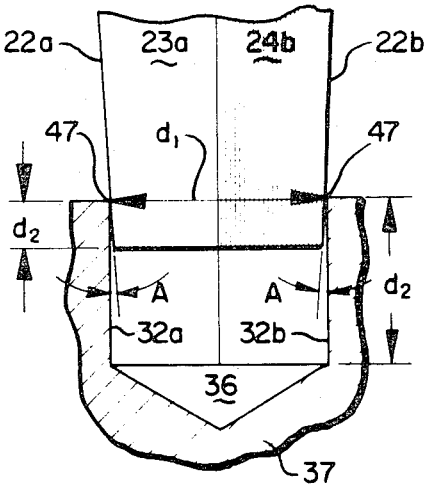
FIG. 6 is an enlarged, fragmentary sectional view, with portions thereof in elevation, taken along the line 6—6 of FIG. 5.

Referring now to FIG. 6 in conjunction with FIGS. 4 and 5, and assuming that the opposite pairs of walls 32*a*,33*a*, 33*a*,33*b*, and 34*a*,34*b*, of the socket 36 have been damaged or mutilated so that the socket has enlarged to the extent that a conventional Allen wrench or other torque applying device is unable to apply a sufficient amount of torque to the head 37 to unthread the screw 38 from the part 41, the construction of the tool 12 which permits removal of the damaged screw will now be described.

Thus, according to the present invention, at least one and preferably each of the three pairs 22*a*,22*b*, 23*a*,23*b*, and 24*a*,24*b* of the sides of the end portion 17 are inclined or tapered inwardly toward the longitudinal axis, indicated at 46 in FIG. 4, of the tool body 17 by an angle of between about 2 to 4 degrees and preferably by an angle of about 3 degrees plus or minus 25 seconds. Such angle is indicated by the letter A in FIG. 6.

In addition to the foregoing inward taper, the sides 22*a*,22*b*, 23*a*,23*b*, and 24*a*,24*b*, of the end portion 17 of the tool body 13 are spaced from each other by a gauge width, indicated at $d_1$ in FIG. 6, which is nominally equal to the space between the upper edge, indicated at 47, of each opposite pair of the side walls 42*a*,42*b*, 43*a*,43*b*, and 44*a*,44*b*, of the socket 36 as initially formed and before damage or mutilation thereof. The axial location of the gauge width $d_1$ on the end portion 17 is such that, when the end portion is forcefully driven into the damaged or mutilated socket 36, such as by one or more blows from a hammer, the portion 17 will penetrate the socket to a distance $d_2$ (FIG. 6), which is between about 15 to 30 percent of the total depth, indicated a $d_3$, of the socket 36. Preferably, the depth of penetration of the end portion 17 is between 22 to 25 percent of the depth $d_3$ of the socket. The aforementioned gauge width $d_1$, together with the aforementioned angular range of taper of the sides 22*a*,22*b*, 23*a*,23*b*, and 24*a*,24*b*, assures that the tool 12 will wedge in the socket 36 and transfer a sufficient amount of torque from the tool to the screw 38 to effect removal thereof from the part 41 with which the screw is threadedly engaged. Since the head 37 of the screw 38 is seated in the recess 42 in the part 43, as is usually the case, removal of the screw 38 without the tool 12 would be very difficult.

It will be understood that the tool 12 will be made in different sizes so that, after determining the size of the socket 36 in the head 37 of the cap screw 38, for example, an appropriately sized tool is selected from a set thereof which will achieve the required wedging action and penetration of the end portion 17 in the socket 36 when the upper end 14 of the tool is impacted into the socket.

After the end portion 17 of the tool 12 is firmly wedged in the damaged socket 36 of the screw 38, torque may be applied to the tool body 13 in any convenient manner, such as by a box or open end wrench, or by a pneumatically or electrically driven impact wrench, until the screw unthreads from the part 41. The screw 38 may then be easily removed from the end portion 17 of the tool 12 in any convenient manner, such as by clamping the body 13 of the tool 12 in the jaws of a vice and driving the screw 34 off of the end 17 of the tool with a hammer. The tool 12 may then be reused as required.

It should be understood that while the tool 12 has been herein described for effecting unthreading of a cap screw having a mutilated hexagonal socket, it could also be used to remove set screws or other types of fasteners having hexagonal sockets which have been damaged or otherwise rendered incapable of receiving an appropriately sized Allen wrench or other similar type of torque applying tool.

While only one embodiment of the invention has been herein illustrated and described in detail, it will be understood that modifications and variations thereof may be effected without departing from the spirit of the invention and the scope of the appended claims.

I claim:

1. In combination, a threaded fastener engaged in a threaded opening in a part, said fastener having a head with a tool-receiving recess therein, said recess having a hexagonal cross-section defined by three pairs of opposite, generally parallel walls extending from an upper edge inwardly to a recess bottom portion, and a tool for removing said threaded fastener from said threaded opening when the recess in the fastener head is damaged or mutilated, said tool comprising:

a generally elongated tool body having opposite ends;

a hexagonally shaped end portion tapering toward and terminating at said one end and receivable within said recess;

said hexagonally shaped end portion having three pairs of opposite, converging sides;

the opposite sides in each pair tapering inwardly at an angle between about 2 to 4 degrees with respect to the axis of said tool body;

means on said sides of the hexagonally shaped end portion, remote from said one end, for wedgedly engaging the upper edge of the recess when said one end is within the recess; and, the spacing of opposite sides of said hexagonally shaped end portion includes a gauge width that is substantially equal to the distance between the upper edge of the wall of a standard size recess in said fastener, and the axial location of said gauge width of said end portion is such that said one end of said tool body is positively spaced from the bottom of said recess when said gauge width is in substantial alignment with the upper edges of the walls of said recess.

2. The combination of claim 1, in which the angle of taper of each of said tool body sides is between about 3 degrees plus or minus 25 seconds.

3. A tool for removing from a threaded opening a threaded fastener having a head with a damaged or mutilated tool-receiving recess wherein said recess has a hexagonal cross-section defined by three pairs of opposite, generally parallel walls extending from an upper edge inwardly to a recess bottom portion, said tool comprising:

a generally elongated tool body having opposite ends;

a hexagonally shaped end portion tapering toward and terminating at said one end and receivable within said recess;

said hexagonally shaped end portion having three pairs of opposite, coverging sides;

the opposite sides in each pair tapering inwardly at an angle between about 2 to 4 degrees with respect to the axis of said tool body;

means on said sides of the hexagonally shaped end portion, remote from said one end, for wedgedly engaging the upper edge of the recess when said one end is within the recess; and, the spacing of said opposite sides of said hexagonally shaped end portion includes a gauge width that is substantially equal to the distance between the upper edge of the wall of a standard size recess in said fastener, and the axial location of said gauge width of said end portion is such that said one end of said tool body is positively spaced from the bottom of said recess when said gauge width is in substantial alignment with the upper edge of the walls of said recess.

4. The tool of claim 3, in which said angle of taper is about 3 degrees plus or minus 25 seconds.

* * * * *